US005885370A

United States Patent [19]

Shimotomai et al.

[11] Patent Number: 5,885,370

[45] Date of Patent: Mar. 23, 1999

[54] METHOD OF HEAT TREATMENT OF STEEL

[75] Inventors: Michio Shimotomai; Akihiro Matsuzaki; Yasunori Yonehana, all of Chiba, Japan

[73] Assignee: Kawasaki Steel Corporation, Japan

[21] Appl. No.: 58,830

[22] Filed: Apr. 13, 1998

[51] Int. Cl.[6] ..... H01F 1/14; C21D 9/52

[52] U.S. Cl. ..... 148/108; 148/595; 148/598; 148/645; 148/653; 148/579

[58] Field of Search ..... 148/108, 579, 148/595, 598, 645, 653

[56] References Cited

U.S. PATENT DOCUMENTS

| | | | |
|---|---|---|---|
| 4,649,248 | 3/1987 | Yamaguchi et al. | 219/10.57 |
| 4,832,762 | 5/1989 | Nakaoka et al. | 148/108 |
| 4,877,464 | 10/1989 | Silgalis et al. | 148/108 |
| 5,089,060 | 2/1992 | Bradley et al. | 148/103 |
| 5,225,005 | 7/1993 | Burage et al. | 148/108 |

OTHER PUBLICATIONS

Chekin, Electomagnetic Densification of Matals for Increasing Castings Cleanliness, Liteinoe Proizvod, (2), 24, (abstract only), 1967.

Kim et al., A Study of Residual Stresses in the Surface Hardening of Blade Mold Frequency Induction Hardening, Surface Coating Technology, 58(2) pp. 129–136 (abstract only), 1993.

*Primary Examiner*—John Sheehan
*Attorney, Agent, or Firm*—Austin R. Miller

[57] ABSTRACT

Magnetic heat treatment of steel, characterized by transforming steel containing about 0.01 to 2.0 mass % of carbon in a magnetic field having a gradient of about 0.1 T/cm or more and about 10 T/cm or less (absolute value) at the Curie point or lower, to effectively refine the microstructure by subjecting the steel to heat treatment in a strong magnetic field having a gradient, followed by advantageously improving the mechanical properties of the steel.

4 Claims, 4 Drawing Sheets

METHOD OF HEAT TREATMENT OF STEEL

BACKGROUND OF THE INVENTION

1. Field of the Invention

This invention relates to magnetic heat treatment of steel, particularly to modification of microstructures of steel undergoing phase transformation in production. This is done by carrying out heat treatment with exposure to a specific magnetic field, followed by advantageous improvement of mechanical properties, as will be further discussed hereinafter.

2. Description of the Related Art

When steel is produced under usual production heating temperatures of 1200° to 1300° C., finish hot rolling temperatures of 800° to 900° C. and coiling temperatures of 400° to 650° C., its resulting microstructure usually comprises a mixed microstructure of phases of pearlite, bainite and martensite, with a ferrite phase and an austenite phase. It has long been known that the fine structure of this mixed microstructure depends on phase transformation which is brought about by cooling from high temperatures to low temperatures.

It is known according to an empirical equation of Hall-Petch that the finer the grains are, the greater the strength, ductility, toughness and fatigue strength of the steel. Accordingly, the constitution of the mixed microstructure is controlled by combination of composition, cooling rate and processing deformation of steel, and the microstructure is so refined that the prescribed characteristics can be obtained.

However, methods in which patterns of temperatures and processing are devised for every steel composition have reached their limits. Completely new methods are required.

A method in which a magnetic field is applied as an external field has been considered for the purpose. Sadovsky et all [Fiz. Metal. Metalloved., vol. 12 (1961) p. 302] of Russia have made it clear by experiments that applying a magnetic field to steel elevates the temperature of martensite transformation and increases the martensite amount. It has been explained that in steel having an ordinary composition, the ferrite and martensite phases are ferromagnetic while the austenite phase is paramagnetic; therefore thermodynamic free energy of the former phase is reduced by magnetic energy. It is believed that, as a result, the driving force for transformation is increased by the magnetic field, so that the transformation temperature goes up. Recent researches have made it clear that the effect exerted on the transformation starting temperature includes high magnetic field susceptibility and forced volume magnetostriction, as well as the effect exerted by magnetostatic energy (T. Kakeshita et al, Japan Metallurgy Association Report 32 (1993), p. 591).

Motivation induced by these theoretical researches has led to researches relating to changing microstructure by applying a magnetic field to industrial common carbon steel [Pustovoit et all, Metalloved. Term. Obrab. Met. (1979) 22). However, distinct effects are not necessarily obtained because the applied magnetic field is as small as 1 T (T designates the unit tesla which represents strength of magnetic field) and details on how to apply the magnetic field were not strictly investigated. The effect of magnetic field exerted on transformation has not yet been applied to the production of steel.

An object of the present invention is to provide magnetic heat treatment of steel by increasing the driving force for transformation, to refine the microstructure, and to improving the mechanical properties of the steel.

SUMMARY OF THE INVENTION

We have intensively researched the effects obtained when a ferromagnetic field is applied to various steels such as medium carbon steel, high carbon steel, low alloy steel and high alloy steel as well as low carbon steel. We have utilized a superconductive magnet and have achieved a marked technical progress relating to the temperature range in which phase transformation takes place in the production process. As a result, it has been found that the ferromagnetic field effect is surprisingly more effective in a heterogeneous magnetic field having a magnetic gradient, as sharply distinguished from a homogeneous magnetic field.

Further, we have found that this effect is expedited further by applying strain to the steel.

In the explanation herein, the Curie point indicates the magnetic transformation point; T represents the unit tesla showing the intensity of the magnetic field. The strain of the steel is the amount of strain observed when dislocation in the steel begins to cause micro deformation to start, and is preferably detected by sticking a conventional strain gauge to the steel.

The expression "positive magnetic gradient" means that the magnetic field grows larger in the direction toward which the steel is moved. Referring to FIG. 4 of the drawings, the steel moves from A to C. When the steel is located between the points A and B it is exposed to a magnetic field having a positive gradient. On the other hand, a negative magnetic gradient can also be applied. This term means that the magnetic field decreases in the direction of steel movement; in other words, when the steel moves from A to C. in FIG. 4, and when the steel is located between the points B and C., the steel is located in a magnetic field having a negative gradient.

BRIEF DESCRIPTION OF THE DRAWINGS

FIG. 3(*b*) is similar to FIG. 3(*a*) but the magnetic field gradient was 1 T/cm.

DESCRIPTION OF THE PREFERRED EMBODIMENTS

To introduce the disclosure of the invention it is convenient at the outset to refer to experimental results, as follows:

Experiment 1

Figure 1:
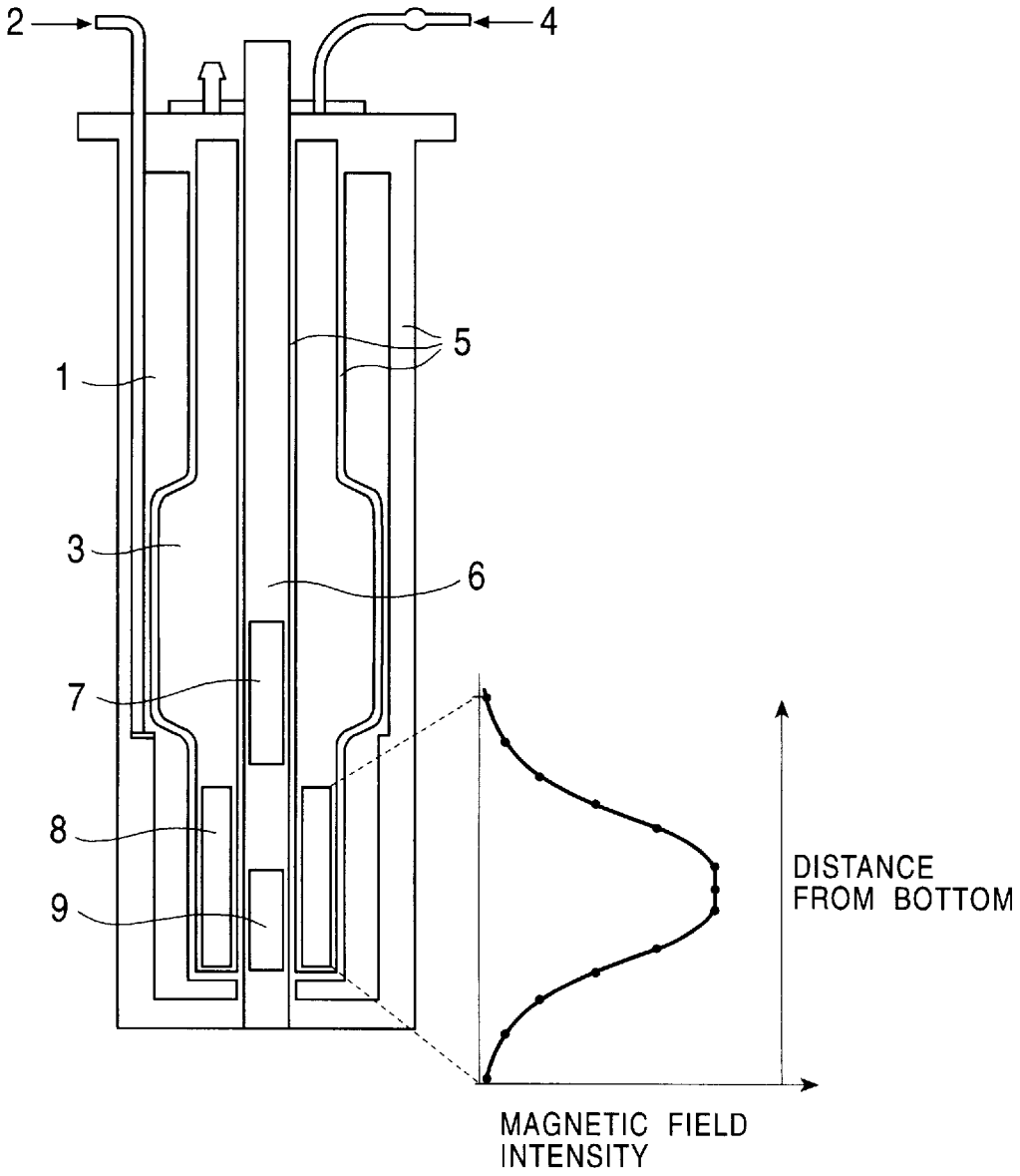
FIG. 1 is a schematic drawing of a suitable heat treating furnace used in the practice of the present invention.

Industrial tool steel slab containing 0.96 mass % of carbon was subjected to hot rolling to prepare a steel sheet having a sheet thickness of 5 mm, and the above steel sheet was charged into a treating furnace shown in FIG. 1 and heated at 870° C. for 5 minutes in an austenitization furnace. Then, the steel sheet was immersed into a lead bath at 560° C. for 2 minutes while applying a magnetic field of maximum 8 T. In this case, three standards of 0, 1 and 10 T/cm were set for a magnetic field gradient.

Figure 2:
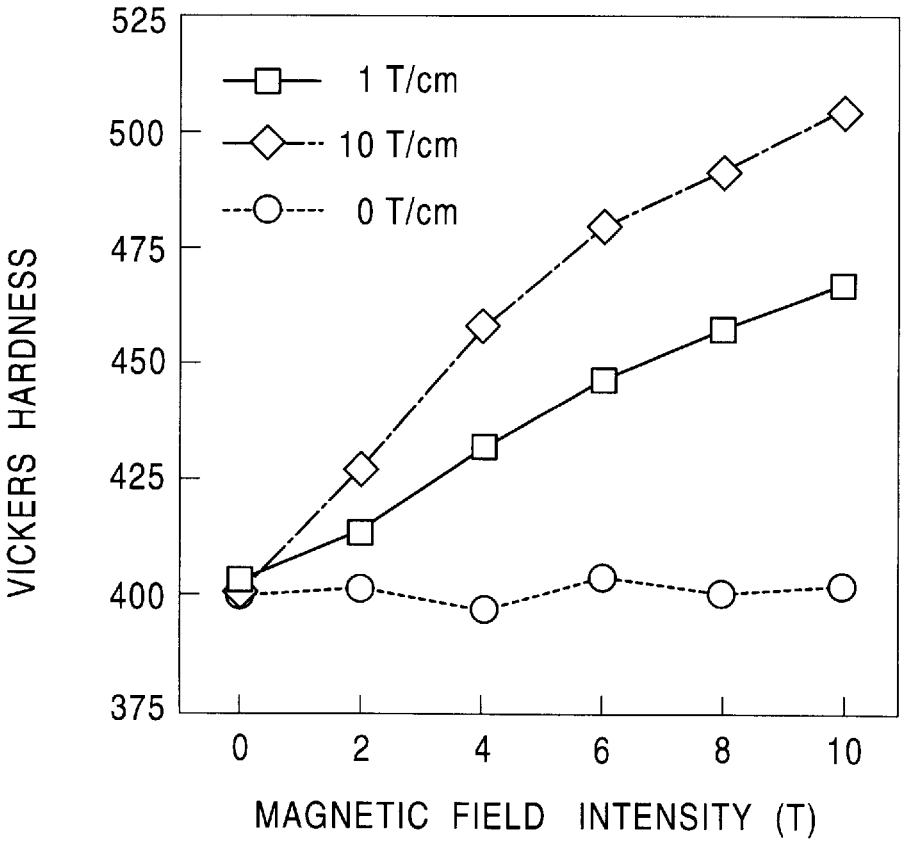
FIG. 2 is a drawing showing the effect of magnetic field gradient exerted on Vickers hardness of steel.

With respect to the mechanical properties of the sample thus obtained, the Vickers hardness was determined, and the results are shown in FIG. 2.

As is apparent from FIG. 2, while improvement of Vickers hardness was not observed when the magnetic field gradient was 0 T/cm, the Vickers hardnesses increased substantially when the magnetic fields had gradient densities of 1 and 10 T/cm.

Figure 3A:
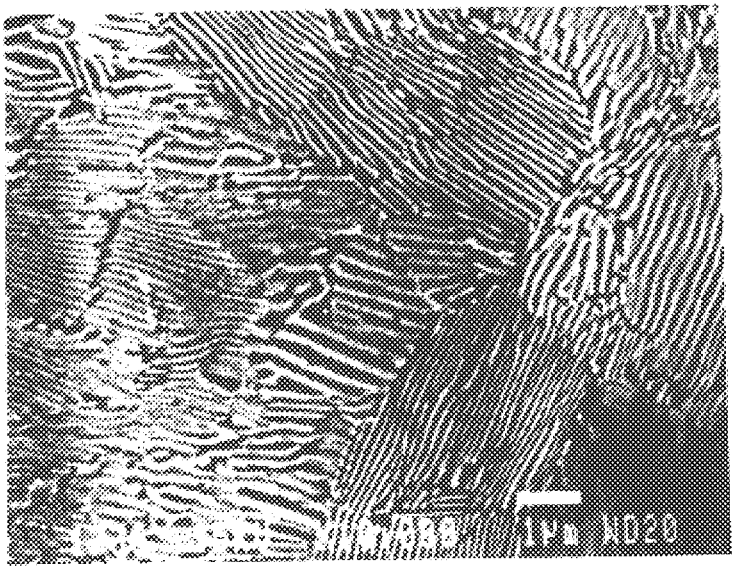
FIG. 3(*a*) is a microscopic microstructural photograph of a steel sample treated at a magnetic field gradient of 0 T/cm.
Figure 3B:
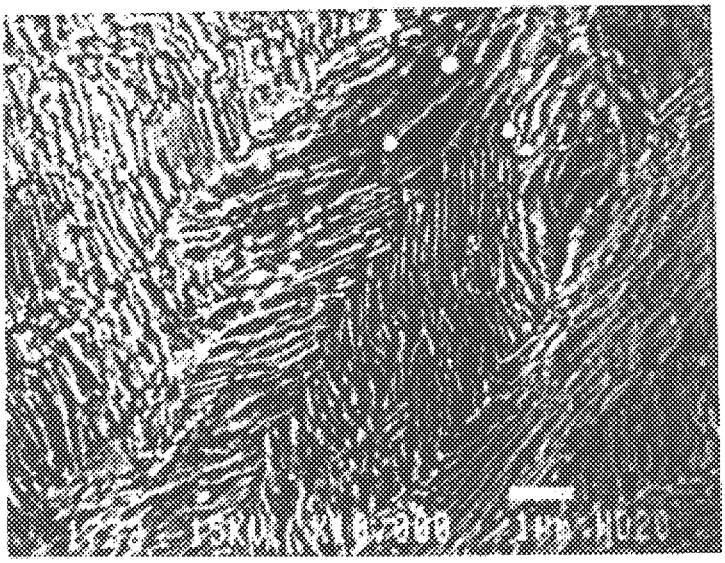
Figure 4:
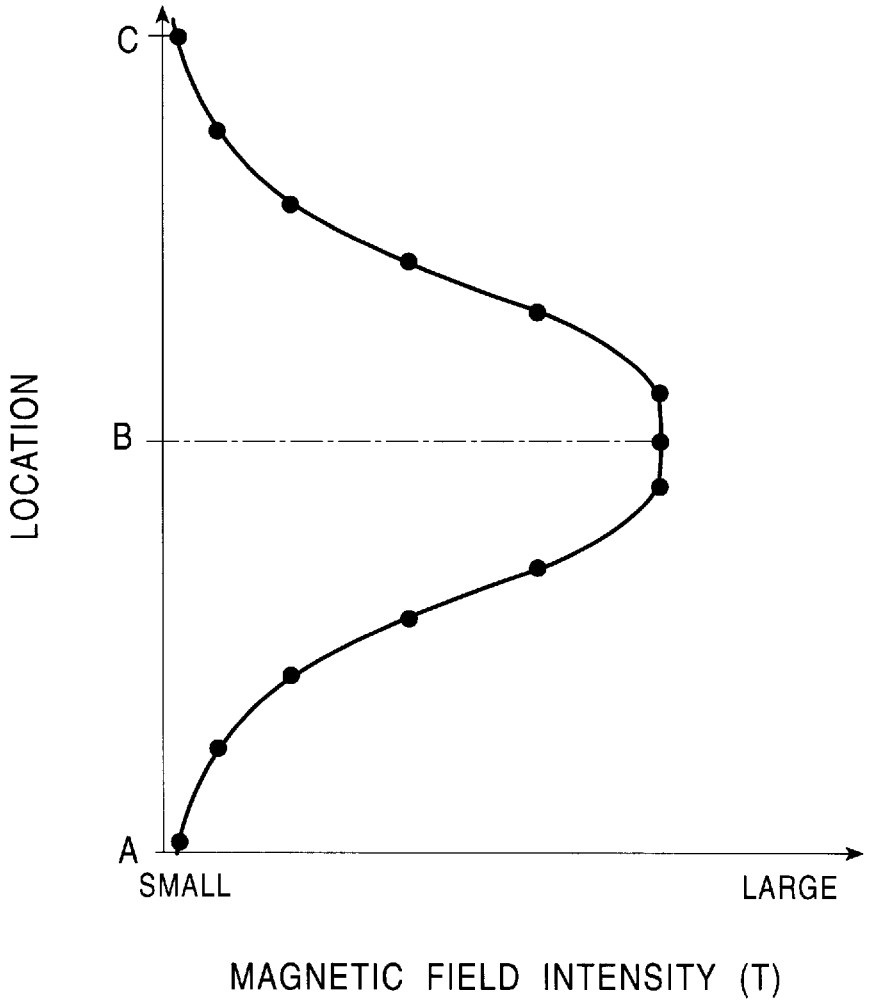
FIG. 4 is a curve plotting location against magnetic field and explains the meaning of positive and negative magnetic gradient.

Further, scanning electron microscopic photographs of the samples treated in magnetic field of 0 T/cm and 1 T/cm are shown in FIGS. 3(*a*) and 3(*b*) respectively. When the gradient was 1 T/cm, portions abruptly pearlite-transformed are present in a high density. This is considered to be a cause of a rise of hardness.

In the heat treating furnace shown in FIG. 1, the numeral 1 represents a liquid nitrogen tank; 2 is an inlet for liquid nitrogen; 3 is a liquid helium tank; 4 is an inlet for liquid helium; 5 is a vacuum insulating area; 6 is a room temperature area; 7 is an austenitization furnace; and 8 is a superconductive magnet. A lead bath furnace 9 is disposed in a magnetic field area excited by this superconductive magnet.

Steel is charged from above and heated to a prescribed temperature in the austenitization furnace 7. Then, it is introduced into the lower magnetic field area and exposed to a magnetic field having a prescribed gradient during cooling, or at a prescribed temperature.

Experiment 2

A piano wire (C: 0.8 mass %, diameter: 1 mm) having a eutectoid composition was austenitized at 900° C. in an air furnace and then maintained at 700° C. for 10 minutes in a magnetic field having an applied magnetic field (maximum) of 8 T and a gradient of 1 T/cm, followed by cooling to room temperature. For the sake of comparison, two kinds of samples were prepared, both subjected to the same treatment at a magnetic field gradient of about zero, one while the applied magnetic field was 8 T and the other while the magnetic field was zero.

The mechanical properties of the respective samples were determined in terms of Vickers hardness. It was found in the three cases that the Vickers hardnesses were 420, 360 and 355, respectively, and that when the strong magnetic field provided a particularly good rising hardness increase.

Experiment 3

The same piano wire (C: 0.8 mass %, diameter: 1 mm) as used in Experiment 2 described above was austenitized and then maintained at 700° C. for 10 minutes in a magnetic field having an applied magnetic field (maximum) of 8 T and a gradient of 1 T/cm while applying a twisting strain of $10^{-4}$, followed by cooling it down to room temperatures to prepare a sample. Its hardness was determined to have a value of 435 at Hv(2).

This experiment made it clear that the presence of strain further promotes the effect of the strong magnetic field.

Experiment 4

Prepared were (a) a sample obtained by passing steel (sheet thickness: 2 mm, width: 50 mm and length: 100 mm) having a carbon concentration of 0.4 mass % through a magnetic field having a strength (center) of 10 T and a gradient of +5 T/cm when cooling the steel from an austenite microstructure; and a sample (b) obtained by passing the steel through a magnetic field of gradient of −5 T/cm. Tension test and Charpy impact test for both of the samples were carried out. Tensile strengths were 1.1±0.1 GPa and Charpy inpact values were 30±J/cm$^2$. They were improved to a major extent as compared with the measured values 0.7±0.1 GPa and 10±1 J/cm$^2$ of the samples produced at zero magnetic field and a magnetic field having a zero gradient. The measurement conditions in the tension test were room temperature and a cross head speed of 10 mm/minute. The Charpy test was carried out with a test piece provided with a V notch.

This experiment has made it clear that the positive or negative sign of a magnetic field gradient is not critical to the achieved effect, facilities using magnetic fields including a positive gradient and a negative gradient can be advantageously employed for continuous magnetic heat treatment of steel sheets, wires and bars.

The mechanical properties of the steel can effectively be increased by applying a strong magnetic field provided with a gradient on the steel when cooling the steel from a high temperature.

The effect of applying a strong magnetic field provided with a gradient has not so far been known to others, and has given remarkable improvements of steel quality in accordance with the present invention. Its mechanism has not yet been made clear, but it can be appreciated by considering the following model.

Applying a strong magnetic field at a temperature at which a ferrite phase having a Curie temperature or lower becomes ferromagnetic reduces free energy mainly by the effect of magnetostatic energy (C. Zener, Trans AIME, 203 (1955) p. 619). It increases the driving force for transformation from a paramagnetic austenite phase. However, while it is recognized that a nucleation-site for transformation is a place where lattice defects are present, such as dislocation, grain boundary and inclusions, applying a homogeneous magnetic field to allow electronic driving energy to grow larger does not always promote transformation.

When coupling between electrons and phonons is large, phase transformation is induced if electronic free energy is lowered by a magnetic field, but it is considered that such is not the case with a steel material.

It is considered that the presence of a magnetic field gradient is essential because a local force is exerted on a place where lattice defects are present by the magnetic field gradient, and this force triggers transformation to go on, even in a lattice defective site which is thought to become active in itself at lower temperatures.

Further, effectiveness of exerting stress deformation together with magnetic field gradient appears to be related to the fact that lattice defect sites are activated against the magnetic field gradient or the density of lattice defects grows large.

It is considered that once transformation nucleus exceeds a critical size, the transformation goes on locally with a portion of the driving energy increased by a strong magnetic field, and that an abrupt microstructure is formed in some cases to form a microstructure having excellent strength and toughness.

It is believed that special reasons apply to the question why the production conditions should be substantially restricted to the ranges described above.

According to this invention, the amount of carbon in the steel should be restricted to about 0.01 to 2.0 mass % in the present invention. Carbon not only is essential for causing phase transformation in light of the phase diagram, but also is effective for homogenizing and refining a hot-rolled microstructure or a cold-rolled microstructure. The lower limit is about 0.01 mass % in view of the iron-carbon phase diagram and the presence of inevitable impurity elements having an effect equivalent to carbon, such as nitrogen. Further, the upper limit of carbon is about 2.0 mass % because otherwise the resulting amount of pro-eutectoid cementite grows larger causing a notable embrittlement in the steel.

Steel according to the present invention may be any selected steel as long as the carbon amount satisfies the range of about 0.01 to 2.0 mass % as described above and phase transformation is effected in cooling after heating.

Accordingly, the present invention can be applied over a wide range of steels extending from low carbon steel to medium carbon steel, high carbon steel, low alloy steel (for example, Ni—Cr—Mo—V steel) and high alloy steel (for example, ferrite base stainless steel and martensite base stainless steel).

Next, the size of the magnetic field gradient is about 0.1 T/cm or more and about 10 T/cm or less, expressed as an absolute value. Since the effect of the magnetic field gradient depends on its absolute value, it does not matter if the value is positive or negative. A value of less than about 0.1 T/cm does not provide the beneficial effect of applying the magnetic field. On the other hand, a value exceeding about 10 T/cm saturates its effect. Accordingly, the magnetic field gradient is in the range of about 0.1 T/cm or more and about 10 T/cm or less.

The upper temperature range of the steel to be processed with the magnetic field should be about the Curie point (770° C.) because the effect of magnetic energy is not produced at a value substantially higher than the Curie temperature.

The intensity of the magnetic field is not specifically restricted in the present invention as long as the magnetic field having the gradient described above is applied. However, if the intensity of the magnetic field is less than about 1 T, the magnetic effect is small and not very practical, and therefore the intensity of the magnetic field is preferably about 1 T or more. With respect to the upper limit, the maximum intensity of magnetic fields capable of being industrially produced in a large space at room temperature or higher is limited to about 40 T.

The magnetic field may be either a direct current magnetic field or an alternating current magnetic field, and the direct current magnetic field is suitable in terms of ease of control.

Further, the amount of strain exerted secondarily on the steel together with the magnetic field is about $10^{-4}$ or higher because a lower amount of strain reduces the effect of reinforcing the magnetic field effect.

The effect of the magnetic field gradient depends on its absolute value. Therefore a positive gradient may be alternated in order with a negative gradient. Particularly in the case of long steel, it is advantageous to pass the steel alternately through a magnetic field having a positive gradient and a magnetic field having a negative gradient since the influence of the drawing force caused by the magnetic field is reduced.

EXAMPLES

Example 1

Steels having compositions shown in Table 1 were subjected to hot rolling processing to prepare steel wires having diameters of 1.5 to 10 mm, and then the steel wires were cooled at a rate of 2° to 10° C./second in a temperature range of 800° to 400° C. with application of the magnetic field conditions shown in Table 2.

Tensile strengths and elongations of the steel wires thus obtained were determined, and the results are shown in Table 2.

The results obtained when the steel wires were cooled under homogeneous magnetic fields and zero magnetic fields for the sake of comparison, are also shown in Table 2. The tensile tests were carried out at room temperature and at a cross head speed of 10 mm/minute. The Charpy test was carried out with a test piece provided with a V notch. The same conditions also apply to the subsequent Examples.

TABLE 1

| Steel | Composition (mass %) | | | | | | |
|---|---|---|---|---|---|---|---|
| symbol | C | Si | Mn | P | Cr | Mo | N |
| A | 0.005 | 0.25 | 0.2 | 0.012 | 0.01 | 0.01 | 0.0025 |
| B | 0.01 | 0.20 | 0.3 | 0.010 | 0.05 | 0.05 | 0.0130 |
| C | 0.45 | 0.15 | 1.2 | 0.011 | 0.2 | 0.30 | 0.0045 |
| D | 0.79 | 0.12 | 1.6 | 0.012 | 0.55 | 0.12 | 0.0065 |
| E | 1.12 | 0.20 | 0.3 | 0.012 | 1.4 | 0.11 | 0.0075 |
| F | 2.1 | 0.30 | 1.2 | 0.012 | 1.1 | 0.15 | 0.0010 |

TABLE 2

| No. | Steel symbol | Steel diameter (mm) | Magnetic field gradient (T/cm) | Maximum magnetic field (T) | Tensile strength (MPa) | Elong-ation (%) | Remarks |
|---|---|---|---|---|---|---|---|
| 1 | B | 5.5 | 1.0 | 5 | 865 | 25 | Invention |
| 2 | B | 2.5 | 0.8 | 10 | 820 | 25 | Invention |
| 3 | C | 2.5 | 10 | 1 | 1300 | 20 | Invention |
| 4 | C | 10.0 | 1 | 12 | 1230 | 20 | Invention |
| 5 | D | 2.5 | 5 | 40 | 1570 | 20 | Invention |
| 6 | D | 8.0 | 0.1 | 10 | 1480 | 20 | Invention |
| 7 | D | 1.5 | 10 | 21 | 1540 | 20 | Invention |
| 8 | E | 5.0 | 2 | 10 | 1830 | 15 | Invention |
| 9 | E | 1.5 | 10 | 1 | 1650 | 15 | Invention |
| 10 | E | 1.5 | 10 | 10 | 1760 | 15 | Invention |
| 11 | A | 3.5 | 10 | 10 | 380 | 25 | Comparative Example |
| 12 | A | 3.5 | 0 | 0 | 390 | 25 | Comparative Example |
| 13 | B | 5.5 | 0 | 5 | 490 | 15 | Comparative Example |
| 14 | B | 5.5 | 0 | 0 | 500 | 15 | Comparative Example |
| 15 | C | 2.5 | 10 | 0.8 | 950 | 20 | Invention |
| 16 | C | 2.5 | 0 | 0.8 | 820 | 10 | Comparative Example |
| 17 | C | 2.5 | 0.05 | 12 | 830 | 10 | Comparative Example |

TABLE 2-continued

| No. | Steel symbol | Steel diameter (mm) | Magnetic field gradient (T/cm) | Maximum magnetic field (T) | Tensile strength (MPa) | Elong-ation (%) | Remarks |
|---|---|---|---|---|---|---|---|
| 18 | D | 8.0 | 0 | 0 | 870 | 10 | Comparative Example |
| 19 | E | 1.5 | 0 | 40 | 930 | 7 | Comparative Example |
| 20 | F | 5.0 | 1 | 10 | Cracks produced in magnetic field | 0 | Comparative Example |

Shown in Table 2 are the properties achieved in the cases of No. 1 to 10 and No. 15. The strength and elongation increases may be compared to those of the cases where the steel wires were treated under homogeneous magnetic fields and a zero magnetic field.

It is shown in Comparative Examples No. 11 and 12 that when the carbon concentration is smaller than about 0.01%, the magnetic field-applying effect does not appear. Further, it is shown in Comparative Example No. 20 that if the concentration of carbon contained in the steel exceeds about 2.0 mass %, the steel is embrittled and can not stand the magnetic field treatment.

Example 2

Steels having compositions shown in Table 3 were heated to temperatures of 1000° C. or higher and 1300° C. or lower and hot-rolled on the condition of a finish rolling temperature of $Ar_1$ point+100° C. to $Ar_1$ point+200° C. Then, the steels were cooled while passing them through a strong magnetic field space having a gradient and coiled (sheet thickness: 5 mm) at 400° to 550° C.

Next, the steel sheets were washed with an acid according to a conventional method and then subjected to cold rolling at a total rolling reduction of 40% or more, in at least two passes, so that the rolling direction of every one pass differed by 45° or more. Subsequently, the sheets were heated to the recrystallization temperature or higher and the $Ar_1$ point or lower at a heating rate of 5° C./second or more and maintained in the above temperature range for 10 to 300 seconds. Then, the steel sheets were cooled down to prepare steel sheets (sheet thickness: 3 mm) having a metal microstructure in which ultrafine spheroidal cementite was dispersed in a fine grain microstructure of ferrite.

Further, in order to confirm the combined effect of magnetic field gradient with strain, tensile strain was applied together to the steel sheets in passing through the magnetic field space in the Examples where so noted.

The tensile strengths, the elongations and the Charpy impact values of the steel sheets thus obtained were determined, and the results are shown in Table 4.

For the sake of comparison, the investigation results of the steel sheets prepared under the same conditions, except that the magnetic field was zero, are shown altogether in Table 4.

TABLE 3

| Steel | Composition (mass %) | | | | | | | | |
|---|---|---|---|---|---|---|---|---|---|
| symbol | C | Si | Mn | P | S | Ni | Cr | Al | N |
| G | 1.35 | 0.21 | 0.22 | 0.009 | 0.003 | 0.04 | 0.44 | 0.002 | 0.003 |
| H | 0.90 | 0.20 | 0.45 | 0.009 | 0.004 | 0.02 | 0.19 | 0.002 | 0.003 |
| I | 0.05 | 0.20 | 0.20 | 0.030 | 0.002 | — | 16.5 | 0.002 | 0.003 |

TABLE 4

| No. | Steel symbol | Magnetic field gradient (T/cm) | Central magnetic field (T) | Applied tensile strain ($\times 10^{-4}$) | Tensile strength (MPa) | Elongation (%) | Charpy impact value (J/cm$^2$) | Remarks |
|---|---|---|---|---|---|---|---|---|
| 1 | G | 1 | 1 | 0 | 1950 | 13 | 16 | Invention |
| 2 | G | 0.1 | 10 | 0 | 1840 | 12 | 15 | Invention |
| 3 | G | 2 | 10 | 0 | 2200 | 14 | 17 | Invention |
| 4 | G | 2 | 10 | 1 | 2400 | 16 | 18 | Invention |
| 5 | G | 2 | 10 | 10 | 2450 | 16 | 19 | Invention |
| 6 | G | 0 | 0 | 0 | 1230 | 5 | 8 | Comparative Example |
| 7 | G | 0.07 | 5 | 0 | 1260 | 5 | 8 | Comparative Example |
| 8 | G | 1 | 10 | 0.5 | 1970 | 14 | 17 | Invention |
| 9 | H | 1 | 1 | 0 | 1750 | 18 | 18 | Invention |
| 10 | H | 0.1 | 5 | 0 | 1700 | 17 | 18 | Invention |
| 11 | H | 1 | 5 | 0 | 1770 | 20 | 17 | Invention |
| 12 | H | 1 | 5 | 1 | 1800 | 23 | 18 | Invention |

TABLE 4-continued

| No. | Steel symbol | Magnetic field gradient (T/cm) | Central magnetic field (T) | Applied tensile strain ($\times 10^{-4}$) | Tensile strength (MPa) | Elongation (%) | Charpy impact value (J/cm$^2$) | Remarks |
|---|---|---|---|---|---|---|---|---|
| 13 | H | 1 | 5 | 100 | 1830 | 23 | 19 | Invention |
| 14 | H | 0 | 0 | 0 | 1200 | 8.0 | 14 | Comparative Example |
| 15 | H | 1 | 0.9 | 0 | 1400 | 15 | 16 | Invention |
| 16 | H | 1 | 0.9 | 1 | 1510 | 18 | 16 | Invention |
| 17 | H | 0 | 1.0 | 0 | 1210 | 7.8 | 13 | Comparative Example |
| 18 | H | 1 | 5 | 0.8 | 1800 | 20 | 17 | Invention |
| 19 | I | 0 | 0 | 0 | 490 | 20 | Not determined | Comparative Example |
| 20 | I | 2 | 10 | 0 | 840 | 30 | Not determined | Invention |
| 21 | I | 2 | 10 | 10 | 940 | 30 | Not determined | Invention |

The results of the steel G are shown in Experiments 1 to 8. It i s shown in No. 1 and No. 2 that the presence of both strong magnetic field gradient and strong magnetic field improves the tensile strength, elongation and Charpy impact value in a good balance. It is considered that comparing the data of No. I with those of No. 2 in detail, the size of the magnetic field gradient is more effective for enhancing the characteristics than the size of the magnetostatic field. The data showing the characteristics raised by magnetic field treatment are shown in No. 3 and No. 4, and the combined effect of the magnetic field with strain is shown in No. 4. Strain was increased by one place in No. 5, and it is confirmed that the characteristics were improved to a larger extent.

In No. 6, the steel sheet was produced by a conventional technique and in No. 7, the steel sheet was produced under a magnetic field condition falling outside the preferred range. In No. 7, almost no improvement of characteristics, against those of No. 6, is observed. It is shown in No. 8 that if the amount of strain applied in combination is less than about $1\times10^{-4}$, the combined effect is poor.

The results of the steel H are shown in Nos. 9 to 18, and the results of the steel I are shown in Nos. 19 to 21. In both cases, substantially the same effects as those of the steel G are positively shown.

Example 3

Hot-rolled members having a thickness of 20 mm which contained 0.12 mass % of C, 0.25 mass % of Si, 1.2 mass % of Mn, 0.005 mass % of P, 0.0035 mass % of S, 0.004 mass % of nitrogen and 0.01 mass % of Al and comprising substantially the remainder of Fe were welded by submerged arc welding. The welded part was put into a magnetic field having a gradient of 2 T/cm and a strength of 1 T for cooling down. In this case, cooling was carried out in the magnetic field while giving a strain amplitude of $10^{-4}$ to the welded part by strong ultrasonic vibration.

After cooling down to room temperatures, a test piece was cut out from the welding heat affected zone to carry out a Charpy test, whereby the brittleness transition temperature was determined.

For the sake of comparison, a brittleness transition temperature of a test piece obtained by welding by a conventional method was determined as well.

As a result thereof, the test piece treated by a conventional method had a brittleness transition temperature of merely −60° C. while the welded test piece obtained by cooling down in the magnetic field had a brittleness transition temperature of −160° C., which was further improved to −190° C. when a strong ultrasonic wave was applied in combination.

It has been confirmed from microscopic observation that a fine ferrite microstructure is formed by cooling down in the magnetic field, and this is considered to lower the transition temperature significantly.

Example 4

A thin steel sheet (having the same composition as the steel C shown in Table 1), which was hot-rolled to a thickness of 2 mm, was continuously passed at a speed of 20 m/minute through a space in which magnetic field gradient densities of 2 T/cm and −2 T/cm were continuously applied alternately in 50 cycles and the magnetic field strength was 5 T in the center. In this case, the inlet temperature was 800° to 750° C., and the outlet temperature was 700° to 600° C.

For the sake of comparison, a steel sheet was treated on the same conditions, except that a homogeneous magnetic field of 5 T having no gradient was applied.

After being wound in coils the steel sheets were measured for tensile strength and elongation at room temperatures to find that the steel sheet treated in the magnetic field having no gradient had the values of merely 820 MPa and 10% respectively, while the steel sheet treated in the magnetic field having a gradient had the values of 1250 MPa and 20% respectively.

This result has confirmed the significance of treatment in a strong magnetic field having a gradient in an industrial scale, using a strong magnetic field space in which positive and negative gradient are continuously and alternately applied.

Accordingly, it will be appreciated that the present invention comprises as essential elements, magnetic heat treatment of steel products, by causing transformation in the steel containing about 0.01 to 2.0 mass % of carbon in a magnetic field having a gradient of about 0.1 T/cm or more and about 10 T/cm or less, at the Curie point or lower, wherein the maximum magnetic field intensity is about 1 to 40 T, wherein the magnetic heat treatment is carried out while providing the steel with a strain of about $10^{-4}$ or more, and wherein the steel is moved in succession through a magnetic field having a positive gradient and a magnetic field having a negative gradienty.

Thus, the microstructure of steel is very advantageously modified by carrying out heat treatment in a strong magnetic field having a gradient according to the present invention, giving rise to achievement of remarkable mechanical properties.

What is claimed is:

1. In a method of heat treatment of steel, the steps which comprise:

(a) providing a steel containing about 0.01 to 2.0 mass % of carbon, (b) introducing said steel into a magnetic field having a gradient of about 0.1 T/cm or more and about 10 T/cm or less, expressed as an absolute value, and (c) transforming phases in said steel in said magnetic field at a temperature substantially at the Curie point or lower.

2. The method defined in claim 1 wherein the maximum intensity of said magnetic field is about 1 to 40 T.

3. The method defined in claim 1 wherein said magnetic heat treatment is carried out while applying strain of about $10^{-4}$ or more to said steel.

4. The magnetic heat treatment of steel as described in any of claims 1, 2, or 3, comprising the further step of moving said steel in succession through a magnetic field having at one time a positive gradient and at another time a magnetic field having a negative gradient.

* * * * *